United States Patent [19]

Fuller et al.

[11] Patent Number: 4,892,250

[45] Date of Patent: Jan. 9, 1990

[54] DYNAMIC FOUNTAIN DISPLAYS AND METHODS FOR CREATING THE SAME

[75] Inventors: Mark W. Fuller, Studio City; Alan S. Robinson, El Monte, both of Calif.

[73] Assignee: Wet Enterprises, Inc., Universal City, Calif.

[21] Appl. No.: 334,781

[22] Filed: Apr. 7, 1989

Related U.S. Application Data

[63] Continuation-in-part of Ser. No. 106,533, Oct. 6, 1987, abandoned.

[51] Int. Cl.[4] ..... F21P 7/00

[52] U.S. Cl. ..... 239/18; 40/406; 40/441; 239/20; 239/69; 364/420; 404/22; 404/42

[58] Field of Search ..... 239/16–18, 239/20, 22, 23, 69, 70, 551, 562; 40/406, 439, 441; 404/22, 36, 42; 364/145, 420, 510

[56] References Cited

U.S. PATENT DOCUMENTS

| | | | |
|---|---|---|---|
| 1,030,301 | 6/1912 | Heughes | 404/22 |
| 2,662,343 | 12/1953 | Rice | 404/42 X |
| 2,794,674 | 6/1957 | Przystawik | 239/16 |
| 3,189,281 | 6/1965 | Booth | 239/17 |
| 3,640,463 | 2/1972 | Kawamura et al. | 239/17 |
| 4,094,464 | 6/1978 | Kawamura et al. | 239/17 |
| 4,111,363 | 9/1978 | Kawamura et al. | 239/17 X |
| 4,269,352 | 5/1981 | Przystawik | 239/17 |
| 4,376,404 | 3/1983 | Haddad | 239/18 X |
| 4,715,136 | 12/1987 | Fuller et al. | 239/17 X |

*Primary Examiner*—Andres Kashnikow

*Attorney, Agent, or Firm*—Blakely, Sokoloff, Taylor & Zafman

[57] ABSTRACT

Dynamic fountain displays and methods of creating the same for providing water displays wnich may substantially constantly vary in interesting and seemingly endless ways. In one form, the fountains are comprised of a matrix of fountain nozzles positioned below a deck formed with open joint paving so as to be useable as a patio or walkway when the fountain is not used. Each nozzle is connected to a source of water under pressure through a proportional control system for that nozzle responsive to a computer output so that each nozzle may be independently and proportionally controlled by the computer as desired. To facilitate the programming of the settings for a large array of nozzles, a plurality such as 256 individual patterns for the array of nozzles are first mutually programmed. Thereafter, by computer control, any one of these predetermined patterns or combinations of patterns with any weighting and scaling may be selected, with the selected pattern or combination frequently being updated such as on 1/16th of a second intervals to provide smooth, abrupt, or intermediate pattern transitions under control of the computer. Lighting for the water display is also disclosed.

17 Claims, 6 Drawing Sheets

FIG.9
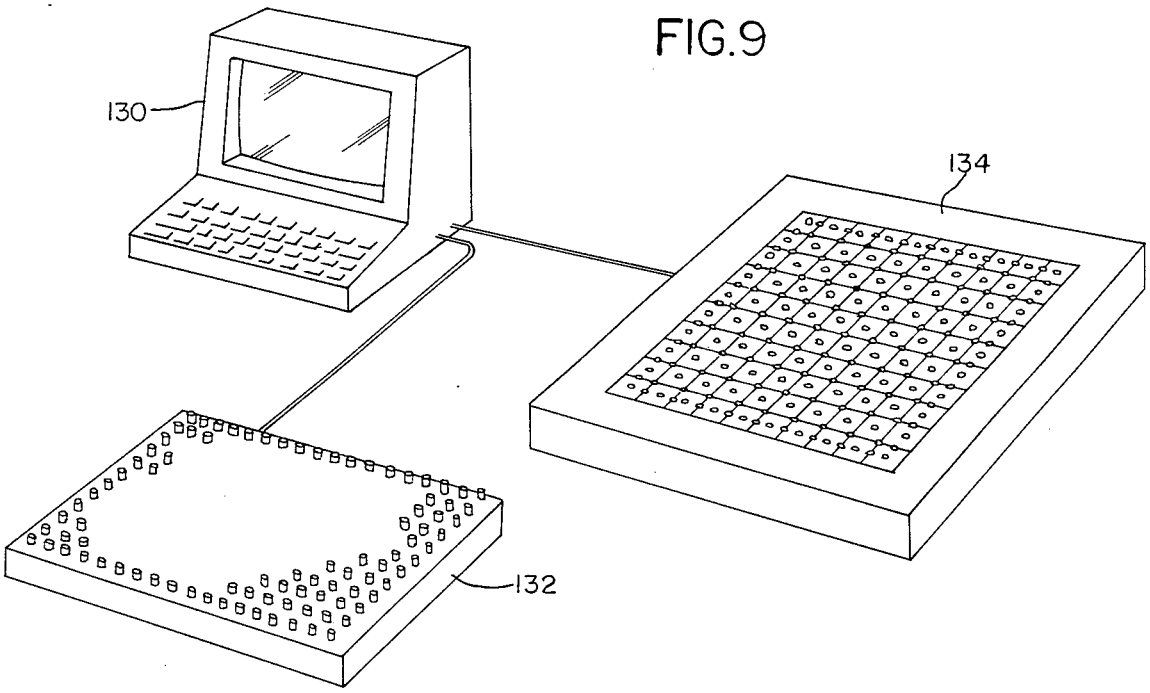
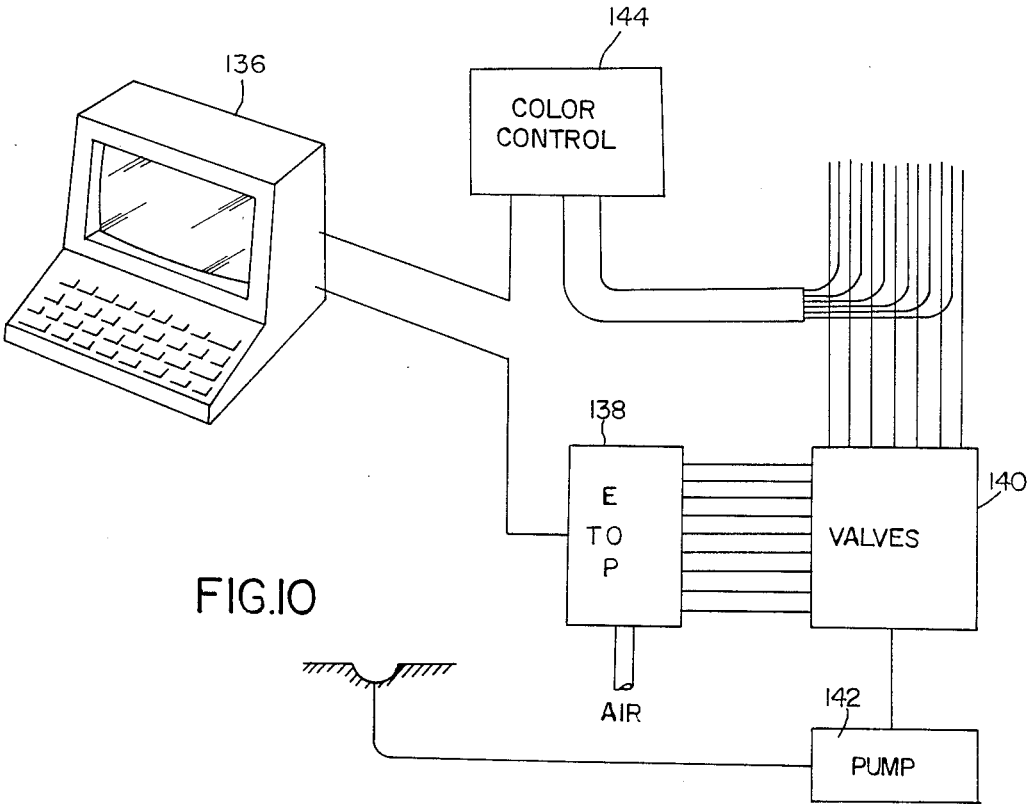
FIG.10

DYNAMIC FOUNTAIN DISPLAYS AND METHODS FOR CREATING THE SAME

This is a continuation-in-part of application Ser. No. 106,533 filed Oct. 6, 1987, now abandoned.

BACKGROUND OF THE INVENTION

1. Field of the invention

This invention relates to the field of water displays.

2. Prior Art

Water displays of various types are of course well known in the prior art. Such displays normally are positioned within one or more pools of water, with the water used in the display returning to the pool for recirculation in the display. Such displays frequently utilize nozzles of various types to direct streams of water in various shapes and form upward in some pleasing pattern for public viewing. In many cases, a plurality of such nozzles may be used, sometimes with various nozzles being turned on and off to give the water display some form of changing character in an attempt to add to the attractiveness thereof. In general, the turning of individual nozzles on and off within a pattern of a plurality of nozzles is relatively easily done, as suitable valves for such purposes are commercially available at a reasonable price and may readily be controlled by various means including simple electromechanical time clocks. In general however, proportional control of the water in such water displays has not been used for various reasons, particularly when the displays utilize a large plurality of nozzles, partially because the cost of providing the proportional control is too high, and partially because of the problem of how to use the proportional control of a large plurality of valves in a meaningful manner to achieve the desired asthetic result. In one aspect, it is the purpose of the present invention to achieve such a water display, and in another aspect, to do so not merely in a conventional fountain pool setting, but rather on a paved deck useable for ordinary foot traffic when the water display is not being used.

BRIEF SUMMARY OF THE INVENTION

Dynamic fountain displays and methods of creating the same for providing water displays which may substantially constantly vary in interesting and seemingly endless ways are disclosed. In one form, the fountains are comprised of a matrix of fountain nozzles positioned below a deck formed with open joint paving so as to be useable as a patio or walkway when the fountain is not used. Each nozzle is connected to a source of water under pressure through a proportional control system for that nozzle responsive to a computer output so that each nozzle may be independently and proportionally controlled by the computer as desired. To facilitate the programming of the settings for a large array of nozzles, a plurality such as 256 individual patterns for the array of nozzles are first manually programmed. Thereafter, by computer control, any one of these predetermined patterns or combinations of patterns with any weighting and scaling may be selected, with the selected pattern or combination frequently being updated such as on 1/16th of a second intervals to provide smooth, abrupt, or intermediate pattern transitions under control of the computer. Lighting for the water display is also disclosed.

BRIEF DESCRIPTION OF THE DRAWINGS

FIG. 9 is a block diagram illustrating the set-up for programming the primitives for the present invention.

FIG. 10 is a block diagram illustrating the control for operation of the water display.

DETAILED DESCRIPTION OF THE INVENTION

Figure 1:
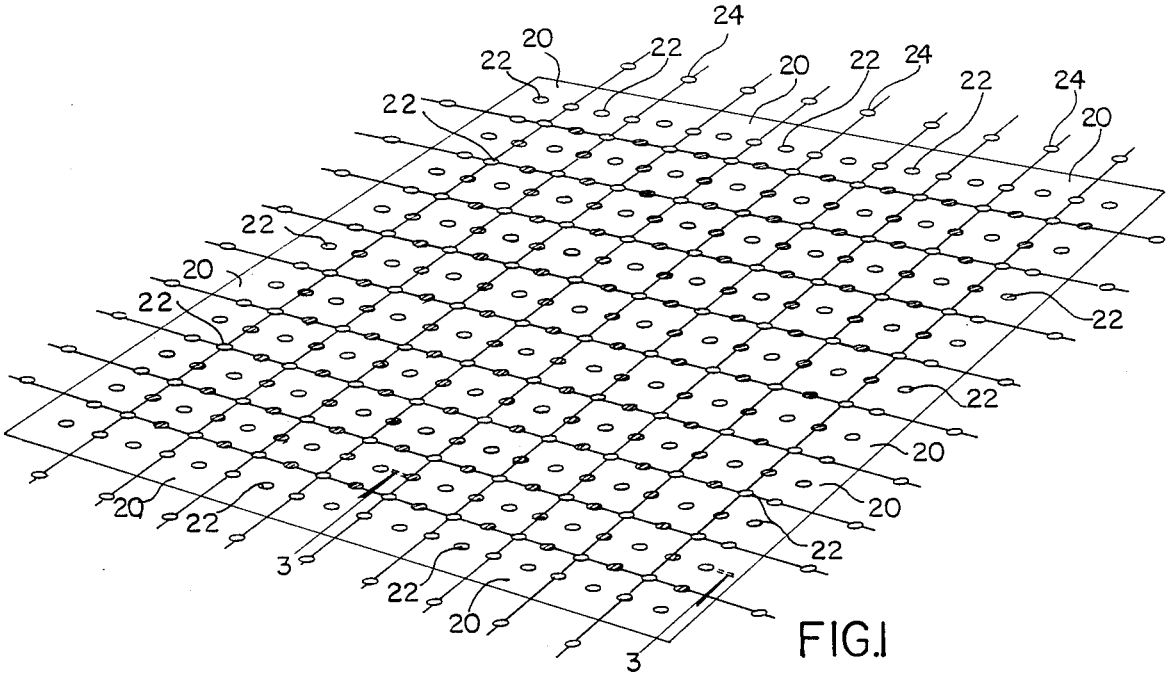
FIG. 1 is a perspective view of a patio area incorporating the present invention.

First referring to FIG. 1, a top view of a portion of a patio deck incorporating the present invention may be seen. Such a patio deck may be, by way of example, a flat patio area associated with a shopping center, entertainment center, or the like, either dedicated for use for its asthetic character, or alternatively at least useable at times for its asthetic quality as provided by the present invention. As shown schematically in the Figure, the decking consists of what is commonly referred to as open joint paving, comprising a plurality of individual squares 20 set in a regular pattern, the squares, as shall be seen, being supported on pedestals from below and separated from neighboring squares by approximately one fourth of an inch. Such separation is not sufficient to normally cause difficulty with ordinary pedestrian traffic, including women in high heels, yet defines a sufficient opening for the removal of rain water therefrom to avoid the requirement of sloping the decking, or alternatively the build-up of puddles thereon. In the present invention, as shall subsequently be seen, the water display is generated by nozzles mounted below the decking and projecting the decorative water stream through the decking in the desired pattern, the space between squares 20 normally used for rain water run-off also being adequate to recover the water display water therethrough for collection thereunder preparatory to recirculation in the system.

As may be seen in FIG. 1, the squares 20 have a plurality of openings 22 therethrough, through which nozzles mounted thereunder may project the desired water stream. In the embodiment illustrated, the openings 22 in the internal region of a pattern are located at the corners of the squares 20. Completely encircling this pattern however are additional openings 22, these openings essentially having one half the spacing, both outward and from one to another, of the openings in the internal pattern, resulting in the outer periphery openings 22 falling on the center of the corresponding squares 20 as well as bridging the opening between adjacent side edges of adjacent squares. Also dispersed in an array intermediate the array of openings 22 are a plurality of light sources 24. These light sources are positioned to bridge the opening between adjacent side edges of adjacent squares both internal to the pattern of nozzle openings 22 and around the periphery of the nozzle opening pattern.

As shall subsequently be seen, the light sources 24 comprise fiber optic bundles mounted so that the tops thereof are just below the tops of squares 20 so as to not be subject to abrasion, etc., by people walking on the patio when the water display is not in use. In the center of the pattern, the tops of the fiber optic bundles are cut off at right angles and polished so that the light emanating therefrom will spread approximately equally in all directions in a cone-like pattern having essentially the same cone angle as the light entering the other end of the fiber optic bundles from the illuminator. In a preferred embodiment, this angle is adequate to illuminate the adjacent plumes of water from adjacent nozzles when the same are turned on to any substantial extent. Around the periphery of the pattern, the light sources 24 have fiber optic bundles which are cut at an angle slopping away from the adjacent pattern of nozzles. Since the speed of light is faster in air than in the material of the fiber optic bundles, such cutting at an angle causes the light coming from the bundles to generally deflect toward the water emanating from the nozzles, so that even though the fiber optic bundles are still set vertically around the periphery, the light eminating therefrom is substantially all directed toward the water display, or at least not toward an adjacent observer.

Figure 2:
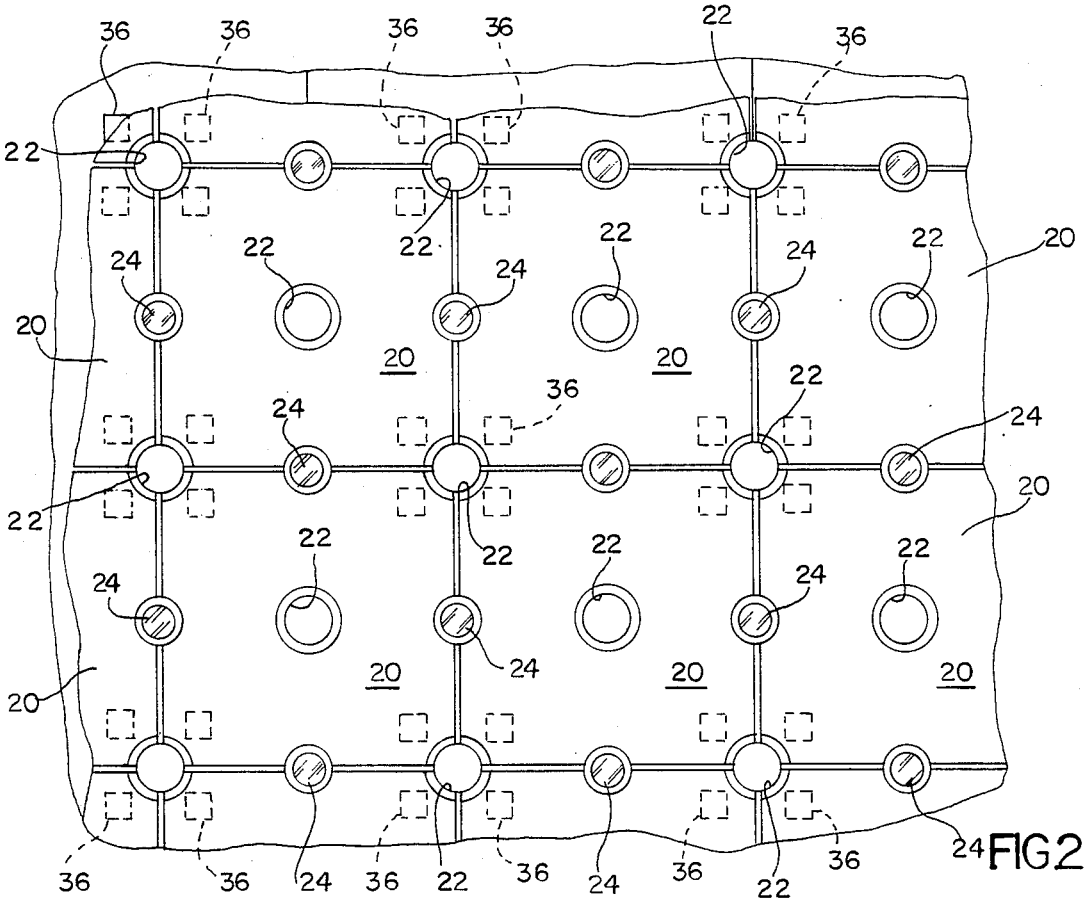
FIG. 2 is a top view taken on an expanded scale of a portion of the patio area of FIG. 1.
Figure 3:
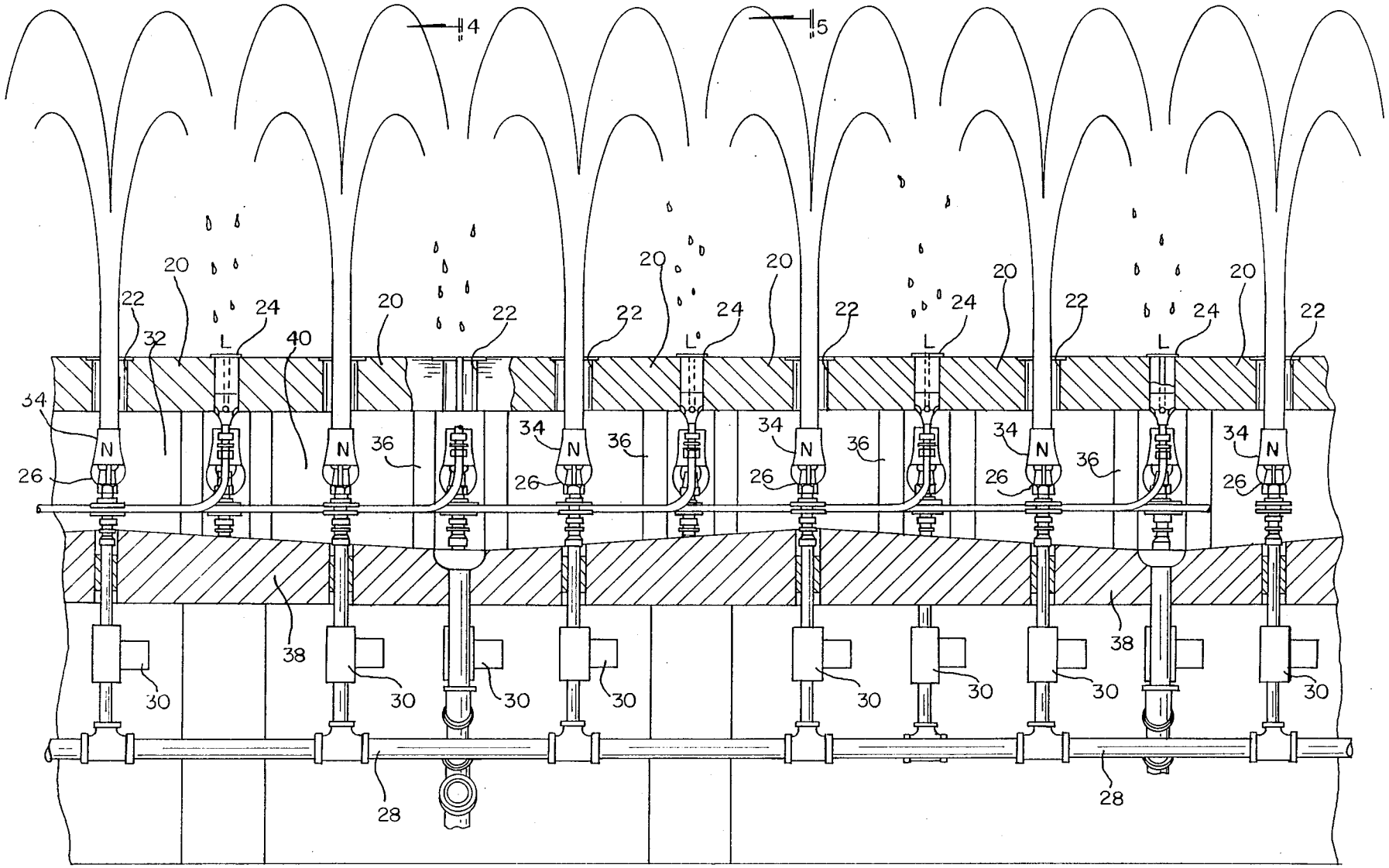
FIG. 3 is a partial cross-section taken along line 3—3 of FIG. 1.

Now referring to FIGS. 2 and 3, the general arrangement of the various elements illustrated in FIG. 1 may be seen. Right below the openings 22 in squares 20 are nozzles 26. Each nozzle is connected to a supply manifold 28 through a proportional control valve assembly 30, the details of which shall be subsequently described. In the preferred embodiment the nozzles 26 are of the entrainment type, normally disposed below water level 32 in the very shallow pool under the patio deck with a bell-like upper protrusion 34 extending through the water surface and being open at the bottom so that when the nozzle is turned on, the primary nozzle flow is augmented by pool water entrained therewith, typically on the order of three to four times the primary flow of the nozzle. This both enhances the asthetic effect and reduces the pumping, piping etc., required for the nozzles located in the corner of the squares.

Each such nozzle is encircled by four pedestal supports 36, the pedestals in turn being supported by the floor or bottom of the pool 38 and supporting a corner of the respective square 20. To maintain the squares in the desired position, small spacers may be used between squares with the spacers being supported as desired, such as from the pedestals themselves. Such spacers may be relatively simple spacers such as metal pieces having a thickness (¼th of an inch) equal to the space to be defined between squares and positioned to project into the gap between squares to assist both in their initial placement and to prevent any drifting thereof with time.

Figure 4:
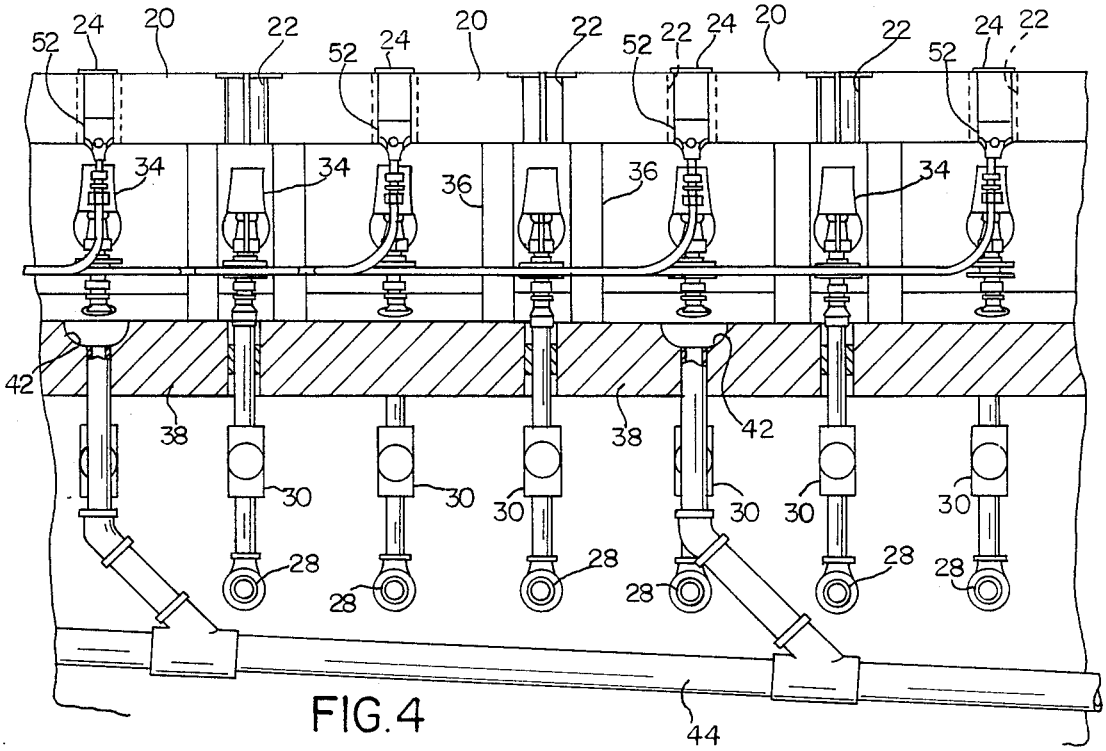
FIG. 4 is a partial cross-section taken along line 4—4 of FIG. 3.
Figure 7:
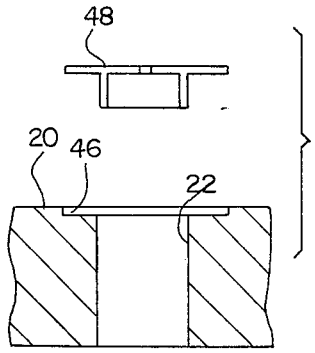
FIG. 7 is a cross-section illustrating the use of a protective cap to cover the openings above the nozzles when the water display is not being used.

The pool of water, indicated by the numeral 40 in FIG. 3, of course is recirculated for the water display. Accordingly, the floor or pool bottom 38 is provided with a plurality of drains 42 (see FIG. 4) which are manifold to a return line 44 for filtering and recirculation of the water in the water display. The use of the plurality of drains 42 avoids the requirement of substantial horizontal flow to a single drain, which could effect the operation of the nozzles. Of course, suitable water level controls, not shown, maintain the level of the surface of the water 32 as desired, adding water in dry weather and directing water to drain during rainy periods. In that regard, each of the nozzle openings 22 is encircled by a slight recess 46 (best illustrated in FIG. 7) allowing a flanged cap 48 to drop thereinto when the patio is to be used as a walkway to provide a flat walkway surface only interrupted by the open joints of the open joint pacing. In that regard, one of the aspects of the present invention is the discovery that water flow rates through open joint paving as hereinbefore used to facilitate removal of rain water is actually adequate for water removal from a very substantial water display, whereby the openings used in the open joint paving may be the same as for conventional walkways, yet still the same can be used for water displays in patio decks etc., for a most unusual and astheticly pleasing visual effect. The caps 48 may have a small opening through the top thereof to facilitate removal, or alternatively in the preferred embodiment of the present invention are chrome plated steel members without any such opening, which members are readily removed when desired by a magnet.

Figure 5:
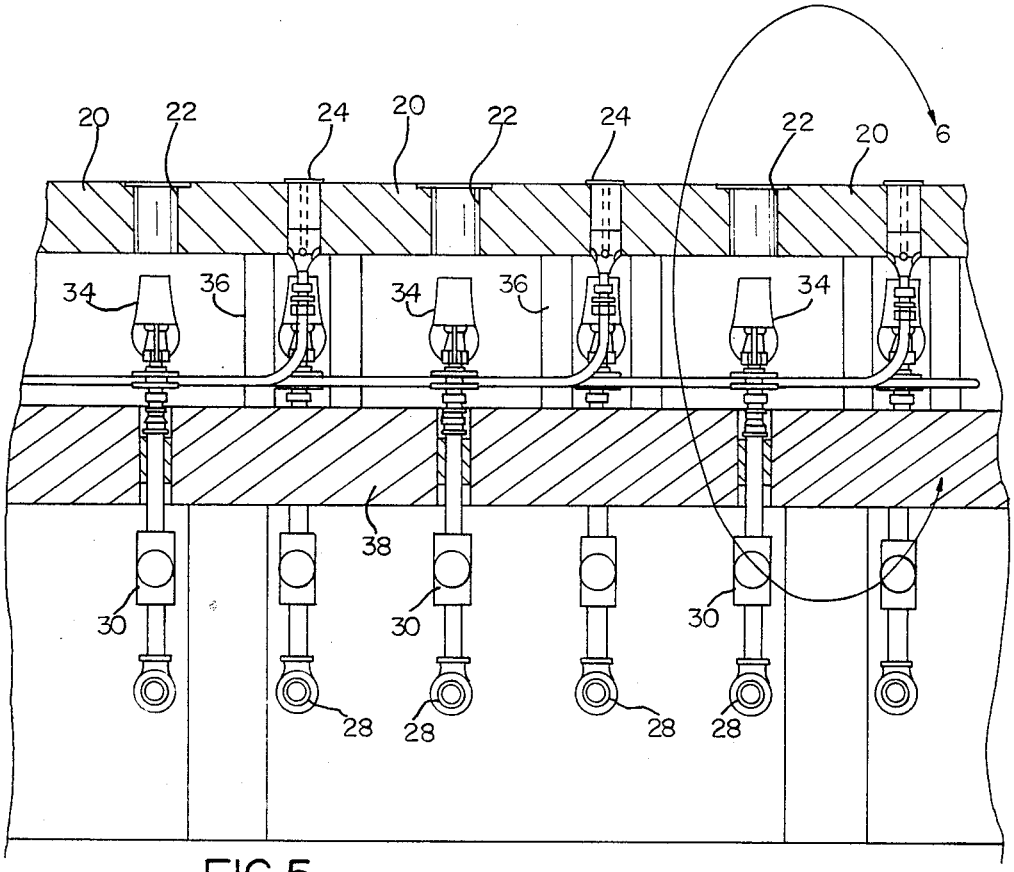
FIG. 5 is a partial cross-section taken along line 5—5 of FIG. 3.
Figure 6:
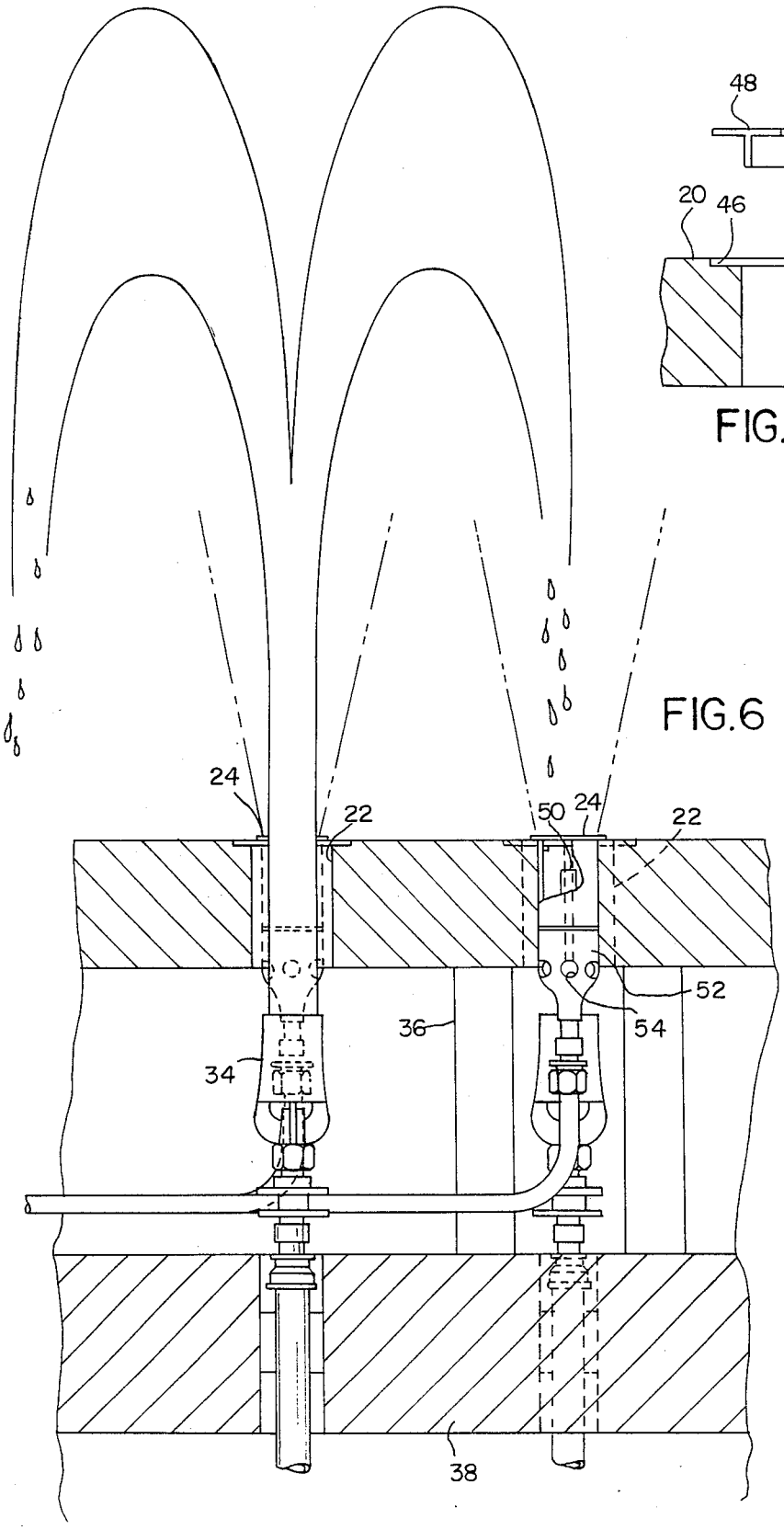
FIG. 6 is a view taken along line 6—6 of FIG. 5 and on an expanded scale.

Now referring to FIGS. 5 and 6, details of the light sources 24 may be seen. Each light source has a fiber optic bundle 50 projecting upward at the center of the light source, the fiber optic bundle in the preferred embodiment being encased in a copper tube or pipe. The copper tube in turn is supported adjacent the bottom of support member 52. Since there is an annular opening between the copper tube supporting the fiber optic bundle and the adjacent enclosure, and because of openings 54 in member 52 providing a drain therefor, water cannot accumulate so as to obscure the top of the fiber optic bundle 50 and interfere with the light emanating therefrom. In that regard, it should be noted that in the preferred embodiment the fiber optic bundle as well the entire light assembly is relatively small and accordingly does not itself interfere with the use of the patio decking as a walkway when the water display is turned off. In the various figures herein, for purposes of clarity, the nozzles as well as the light sources are drawn proportionally larger than normal so as to sufficiently illustrate the detail thereof in comparison to the much larger squares 20 of the patio.

Figure 8:
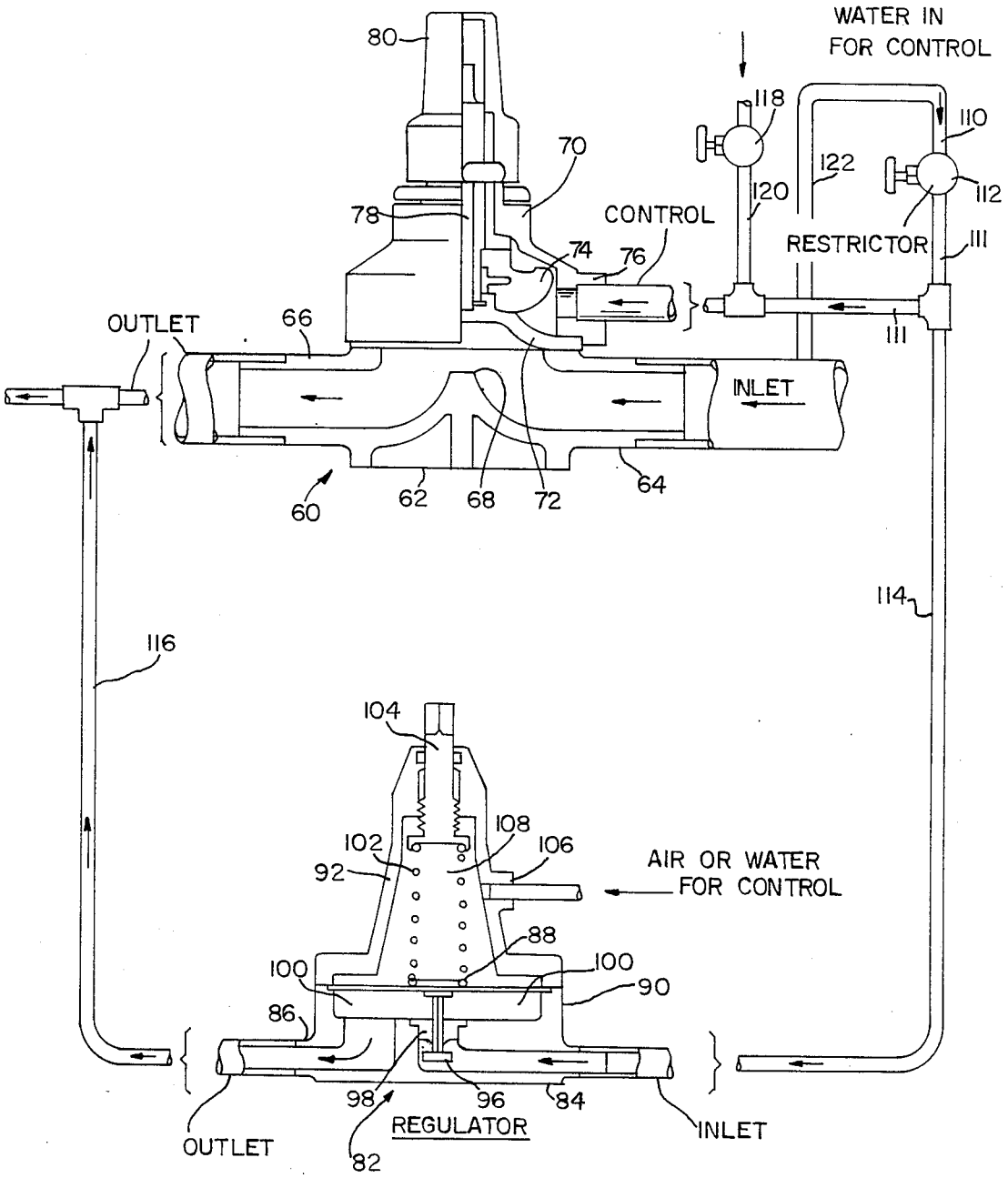
FIG. 8 is a schematic partial cross-section illustrating the proportional control valves used for the present invention.

Now referring to FIG. 8, a schematic illustration of a representative proportional control valve assembly 30 shown in partial cross section may be seen. The valve, generally indicated by the numeral 60, is comprised of a main valve body 62 having an inlet port 64 and an outlet port 66, with a weir 68 separating the inlet and outlet ports. Mounted above the weir 68 and retained by cover 70 is a diaphragm 72 having a chamber 74 thereabove coupled to a control pressure port 76. In the particular valve shown, the diaphragm is coupled to a central member 78 extending through cover 70 and sealed with respect thereto to provide a visual indication of the diaphragm position through clear plastic cap 80. The basic arrangement of inlet port, outlet port, weir, diaphragm and control pressure chamber and associated port for controlling the diaphragm position are characteristic of diaphragm valves of the type used with the present invention, though the additional apparatus for providing a visual indication of diaphragm position is a feature of the particular valve illustrated not required in the present invention.

Illustrated below the valve 60 in a somewhat enlarged schematic form is a pressure regulator, generally indicated by the numeral 82, also comprised of an inlet port 84, an outlet port 86 and a diaphragm 88 retained between body 90 and cover 92 of the regulator. The diaphragm 88 operates in conjunction with a valve member 94 which has a valve closure member 96 which, when in an upper position, engages seat member 98 to seal off the inlet port 84 from chamber 100 below the diaphragm. When the diaphragm is forced downward however, the valve member 94 is forced downward, forcing the valve closure member 96 off of seat member 98, allowing fluid flow between the valve member 94 (relieved for this purpose) and the valve seat member 98 into chamber 100 and the outlet port 86. In operation, coil spring 102, the preload of which is adjusted by adjustment 104, forces the diaphragm downward to open the valve and allow fluid flow between the inlet port 84 and the outlet port 86, the valve closing when the pressure in the outlet port 86, and more particularly in chamber 100, reaches the desired regulated pressure, at which time the force upward on the diaphragm by the regulated pressure offsets the downward force in coil spring 102 to allow the valve to close. Coupling of an additional control pressure through the control port 106 to chamber 108 over the diaphragm increases the downward force on the diaphragm, resulting in a proportionate increase in the regulated pressure output of the regulator.

In addition to the valve 60 and regulator 82, FIG. 8 shows various fluid communication means interconnecting various components to provide the desired overall result. In particular, line 110 is coupled between a source of fluid at an elevated pressure and the control port 76 of the valve through a flow restrictor 112 and line 111. Also coupled to line 111 at a point downstream of the flow restrictor 112 is the inlet port 84 of regulator 82, the connection being made through line 114 as shown in FIG. 8. The outlet port 86 of the regulator in turn is coupled to the outlet port 66 of the valve 60 through line 116. Finally, in the embodiment shown in FIG. 8, a bleed port is provided through valve 118 and line 120 to allow the bleeding of substantially all air from the chamber 74 of the diaphragm valve and the various lines provided flow to and from the chamber. Also in the specific embodiment shown, line 110 supplying high pressure fluid through restrictor 112, is coupled to the inlet port 64 of the valve through line 122, though if desired, any source of the fluid at an elevated pressure would be suitable for such use.

In operation, bleed valve 118 is maintained closed. Fluid at an elevated pressure is delivered to the high pressure side of the flow restrictor 112, with a limited flow of fluid passing through the flow restrictor depending upon the setting of the restrictor and the pressure differential across the restrictor. The fluid passing through the restrictor will pass through line 114 to the regulator 82, only small amounts of control fluid flowing to and from the control port 76 of the valve 60 for control purposes. If the outlet pressure of the valve 60 is equal to the regulated pressure setting, the flow rate through the regulator will stabilize so as to control the pressure in line 114 and thus the pressure in the control port 76 of the valve 60 to hold the valve in that desired position.

It may be seen that the operation of the assembly is stable by considering a perturbation in the system. By way of example, assume that the outlet pressure of the valve is momentarily low. The regulator in response thereto will open to allow a greater flow therethrough, attempting to build up the pressure at the outlet to the preset regulated value. This in turn will cause increased flow in line 114 and thus a greater pressure drop across the flow restrictor 112 reducing the pressure on the control port 76 of the valve 60 to allow the valve to open enough to increase the pressure at the valve outlet to the regulated valve. Similarly if the pressure at the outlet 66 of valve 60 is momentarily above the regulated pressure, the regulator will move toward the closed position, reducing the flow in line 114, reducing the pressure drop across the flow restrictor 112 and raising the pressure on the control port 76 of the valve 60 to move the valve diaphragm further toward the closed position to reduce the flow through the valve as required to reduce the pressure in the outlet port 16 thereof to the regulated pressure.

The system is stable in part due to the relative incompressibility of the fluid passing through the valve and as used for control. In that regard, for speed of response and stability, the air should be bled out of the system prior to use. In general the pressure regulator 82 will be self-purging, through air may be trapped in chamber 74 of the valve 60 as well as the line connected to the control port 76. Accordingly, for purposes of bleeding the air from this portion of the system, line 120 with bleed valve 118 is provided.

The source of high pressure fluid applied to the flow restrictor 112 may be the same source as used to supply the fluid to the valve inlet port or alternatively, may be some other elevated pressure source. The flow restrictor itself could be a viscous restrictor, a square law restrictor (orifice) or something in between. In that regard, an orifice might theoretically be best as providing a wider range of pressure drops for a given range of flow variation, though in practice a simple valve adjusted to an appropriate partially open position is highly satisfactory. The opening should be limited to that which will restrict the flow of the highest pressure drop that must be sustained through the valve to a flow rate which can be handled by the pressure regulator 82. While the system will operate with a very small opening of the valve 112, flow rates into and out of the control port 76 of the valve will also be highly restricted, which may make the response of the system to a transient disturbance or a commanded pressure variation unreasonably slow. In that regard, as pointed out before, the regulated pressure of the pressure regulator may be varied by applying appropriate control pressure through port 106 of the pressure regulator 82. Since the control fluid used to control the regulated pressure in this manner is in general not mixed with the fluid passing through the valve 60, the control fluid used to control the pressure regulator can be chosen independently and may be either a gas or liquid as desired. In a typical fountain application, voltage to pressure convertors are used for computer control of the system utilizing air as the control medium. Accordingly, the system of the Figure is readily controllable by computer with a minimum overall system expense.

Now referring to FIG. 9, a the set up which can be used for programming the system of the present invention may be seen. The system comprises three major elements, specifically, a personal computer 130, a control board 132, and a "display board" 134. The display board 134 comprises a miniature fountain in accordance with the fountain being programmed, the fountain in FIG. 1 in the present description. Thus the 217 fountain nozzles and proportional control valve assemblies of the fountain in FIG. 1 are represented by a similar array of 217 small vertically oriented tubes, each tube being connected to a voltage to pressure converter supplied with water by an appropriate pump. Since the purpose of the display board 134 is to create a miniature replica of the water display of FIG. 1, the voltage to pressure converters, though having a relatively low flow capability, provide an adequate flow to be directly used in the miniature display. A control board 132 having individual controls for each of the nozzle locations in the display board 134 provides a manual proportional control at each corresponding array position on the control board. For this purpose, potentiometers are conveniently used, the potentiometers being read by computer 130 on a scanning basis with the settings thereof converted to respective voltages for control of the voltage to pressure converters in the display board 134.

Then preferred technique of programming, however, is to simple use the control board and computer directly. In particular, by using linear potentiometers, each adjustable by the vertical position of the adjustment member, and appropriately electrically and physically orienting the potentiometers with respect to the board so that the vertical position of each control represents the desired vertical height of the stream form the respective nozzle in the fountain, the potentiometers, once set as desired for a particular pattern, may be scanned by the computer on command to record the settings for that particular pattern, after which new patterns may be set and recorded as desired.

In general, the in FIG. 9 is used to adjust to desired water patterns in the miniature display board 134 and to then record such setting, storing the same in computer 130 and ultimately on disk for later use in the "play back" system. An individual set of settings for the entire array is referred to as a primitive as such settings form the primitive or basic settings from which the dynamic display is generated. In the preferred embodiment the system is programmed to handle up to 256 primitives, though a larger number could be accommodated if desired. These primitives represent basic water display patterns from which other patterns, including changing patterns, may be generated. Typical primitives may include a setting of all valves so that the water emitted from all nozzles has the same height. A second primitive may represent a corner nozzle on a maximum, the opposite corner off, and those in between on in varying amounts so that the top of the water display over the area is substantially flat but decreases from full height at one corner to zero at the opposite corner. Primitives 3, 4 and 5, by way of example, might represent the same general pattern as with primitive 2, but rotated progressively in 90 degree increments. Whatever the various primitives may be, once the settings for a particular primitive have been made, the settings for each valve are recorded as the data for that primitive. Obviously one can create a very substantial library of primitives as desired, generally only limited by the imagination of the person creating the primitives. As alternatives, one might generate the miniature display through computer graphics, and adjust the pattern as desired through the computer keyboard, or even establish algorithms to calculate basic primitive shapes.

The system for utilizing the primitives to provide proportional control of each valve to create the dynamic water display may be seen in FIG. 10. In this system, another personal computer 136 operating under program control utilizes the primitives as data to provide control voltages to the plurality of voltage to pressure converters 138, each of which controls a respective one of the proportional control valves 140 (see FIG. 8 for a typical such valve) using air as the control medium. The valves of course are supplied by water under pressure by pump 142 drawing water from the pool below the patio deck, the filters etc., used in a typical system not being shown. The computer 136 updates the 217 control valve settings 16 times per second, this repetition rate together with the resolution in the control providing essentially a continuous proportional control of each valve. In that regard, while the data of the primitives is used by the program to determine the valve settings, any set of 217 settings for a given 1/16th second update may be determined not only by any one primitive, but may comprise any weighting of up to four primitives. In equation form this may be expressed as follows:

$$S(x,y)=k_o(k_1S_{pm}(x,y)+k_2S_{pn}(x,y)+k_3S_{po}(x,y)+k_4S_{pp}(x,y))$$

Where:

$S(x,y)$ = the setting for the valve controlling the nozzle at matrix location x,y $S_{pm}$ (x,y), $S_{pn}$ (x,y), $S_{po}$ (x,y) and $S_{pp}$ (x,y) = the setting for the valve controlling the nozzle at matrix location x,y in the primitives m, n, o and p $k_o$ = Overall scale factor, ranging from 0 to 1 kl, k2, k3, and k4 = weighting constants applicable to any one set of settings for a 1/16 second update, which constants may be varied as desired between successive updates.

$$k_1+k_2+k_3+k_4=1$$

As may be seen, the constant $k_1$, $k_2$, $k_3$, and $k_4$ are constants applicable to any one setting, but which may be varied between successive settings to achieve whatever effect is desired. In that regard, the constants may be suddenly changed or essentially slowly changed with time under program control so that the display may suddenly change or slowly change with time as desired. Also of course, which primitive or primitives are being used at any one time may also be varied under program control. Thus, by way of a more specific example, five exemplary primitives were previously described, the first being all nozzles on to provide a uniform pattern, with the other four being a successive 90 degree inclined pattern with one corner at a maximum and an opposite corner at zero flow. In such a case, one might start a sequence by first giving maximum weighting to the first primitive ($k_1=1$) and no weighting to any other primitive, so that first the uniform flow comes on, being repeated for perhaps 2 or 3 seconds. Thereafter, the weighting on the first primitive might be reduced slowly as the second primitive was added with a corresponding slowly increasing weighting, until the pattern being displayed comprises an equal weighting of the first and second primitives. This will result in an inclined water pattern, though not going to zero at the low side, but rather to approximately ½ maximum height. Thereafter, under program control, the weighting on the second primitive might be slowly reduced as the third primitive was added at a corresponding increasing weighting, so that the pattern being displayed would appear to be slowly sliding from a combination of the first and second primitives to a combination of the first and third, giving the appearance of rotation of the inclined pattern. Obviously, when the weighting of the second primitive decreased to zero, the fourth primitive would be slowly added as the third primitive was decreased, etc., creating the illusion of continual rotation of the inclined pattern. Since the updates occur at each 1/16th of a second, the rate at which this occurs could be steadily increased from a very slow rate, causing the pattern to appear to rotate at increasing speed, as one might slosh coffee around the inside of a cup. Thereafter, the weighting on the first primitive might be steadily decreased so that the height of the entire pattern diminished, as if water was being lost from the rotating pattern, with the weighting on the two primitives remaining at any time after the first decreases to zero then decreasing so that the pattern continues to rotate with diminishing intensity until fully disappearing, after which some other sequence could be started. Note that in the examples given, no more than three primitives are used at any one time, and that while switching between primitives there is a jump type change, a jump or a smooth transition may be achieved depending on whether the new primitive has a substantial initial weighting or a weighting which slowly increases from zero. Note also that because the voltage to pressure converters are located substantially at the proportional control valve assembly, the response of the proportional control valve assembly is very fast, though of course there is some limit to how fast patterns may be changed because of the time response limit imposed by the motion of the free water in response to gravity.

As may be seen in FIG. 10, the computer 136 also controls a color control 144 which controls the color of the light provided to the fiber optic bundles illuminating the water display. As may be seen in FIG. 1, the array of light sources comprises a total of 180 fiber optic bundles, including those around the periphery of the pattern, for illuminating the display. In a preferred embodiment, the array is broken down into six spatial zones yielding 30 fiber optic bundles per zone. An illuminator in each zone contains 10 individual light sources or lamps, with each lamp illuminating 3 fiber optic bundles. The color control 144 (FIG. 10) provides a control to adjust the position of a device bearing translucent plastic panels thereon of various colors so as to control which color of the light will be allowed to pass out through the fiber optic bundles to illuminate the display. In essence the color control 144 functions much like a color wheel to allow the change of color of the illumination of the water display under computer control in synchronism with the pattern changes.

There has been described herein new and unique water displays suitable for a variety of uses. In one aspect, the present invention utilizes open joint paving to achieve water displays heretofore only achievable through the use of conventional fountain pools. In another aspect, the present invention provides a water display with a large number of nozzles each controlled in a proportional manner to provide interesting and dynamic patterns changing with time to command the attention of those watching the pool. The embodiment disclosed utilizes 217 nozzles, though obviously other numbers of nozzles may be used as desired, preferably at least ten nozzles, and more preferably one hundred or more to provide maximum dynamic effect of the proportional control. Thus, while the present invention has been disclosed and described herein with respect to a preferred embodiment thereof, it will be understood by those skilled in the art of various changes in form and detail may be made therein without departing from the spirit and scope of the invention.

We claim:

1. A patio fountain comprising:

a base extending over an area, the said base including drain means for collecting water from above for recirculation;

a patio deck supported above said base, said patio deck having a plurality of deck members supported adjacent each other in slightly spaced apart relationship for allowing water to pass therebetween to said base;

a plurality of nozzles disposed in a pattern to direct water upward through corresponding openings in said patio deck; and, pump means coupled between said drain means and said plurality of nozzles for recirculating water collected by said base;

whereby a water fountain display is formed utilizing open joint paving and without using one or more fountain pools.

2. The patio fountain of claim 1 further comprising means for covering said openings in said patio deck when said fountain is not being used.

3. The patio fountain of claim 1 further including means for illuminating the water fountain display with colored light.

4. The patio fountain of claim 3 wherein said means for illuminating the water fountain comprises illumination means directing light upward through openings in said patio deck in a plurality of locations cooperatively located with respect to said plurality of nozzles.

5. The patio fountain of claim 4 wherein said means for illuminating the water fountain comprises at least one colored light source means and a plurality of fiber optic bundles.

6. The patio fountain of claim 1 further comprised of a plurality of controllable valves and control means for controlling said controllable valves, each of said controllable valves being located between said pump means and a respective said nozzle, whereby the flow of water to each nozzle may be independently controlled.

7. The patio fountain of claim 6 wherein said control means comprises a means providing a time varying control signal to said controllable valves and wherein said controllable valves are proportionally controllable in response to said time varying control signal.

8. A water display comprising:

a plurality of nozzles disposed in a pattern to direct water upward;

collection means for collecting water emitted by said nozzles;

pump means for pumping water from said collection means to said nozzles; and, a plurality of remotely controllable valves, each proportionally responsive to a control signal provided thereto, each of said valves being located between said pump means and a respective said nozzle, whereby the flow so water to each nozzle may be independently proportionally controlled from a central control.

9. The water display of claim 8 further comprising electronic means for providing a time varying control to said proportionally controllable valves to create a dynamic water display.

10. The water display of claim 8 wherein said control means is a digital control means.

11. A patio fountain comprising:

a base extending over an area, the said base including drain means for collecting water from above for recirculation;

a patio deck supported above said base, said patio deck having a plurality of deck members supported adjacent to each other in slightly spaced apart relationship for allowing water to pass therebetween to said vase;

at least one nozzle disposed to direct water upward through at least one opening in said patio deck; and, pump means coupled between said drain means and said at least one nozzle for recirculating water collected by said base;

whereby a water fountain display is formed utilizing open joint paving and without using one or more fountain pools.

12. The patio fountain of claim 11 further comprising means for covering said at least one opening in said patio deck when said fountain is not being used.

13. The patio fountain of claim 11 further including means for illuminating the water fountain display with colored light.

14. The patio fountain of claim 13 wherein said means for illuminating the water fountain comprises illumination means directing light upward through openings in said patio deck in a plurality of locations cooperatively located with respect to said at least one nozzle.

15. The patio fountain of claim 14 wherein said means for illuminating the water fountain comprises at least one colored light source means and a plurality of fiber optic bundles.

16. The patio fountain of claim 11 further comprised of a controllable valve for each of said at least one nozzle and control means for controlling said controllable valves, each of said controllable valves being located between said pump means and a respective said nozzle, whereby the flow of water to each nozzle may be independently controlled.

17. The patio fountain of claim 16 whereby said controllable valves are proportionally controllable and wherein said control means comprises a means providing a time varying control to said controllable valves.

* * * * *

UNITED STATES PATENT AND TRADEMARK OFFICE

CERTIFICATE OF CORRECTION

PATENT NO. : 4,892,250

DATED : 1/9/90

INVENTOR(S) : Fuller et al.

It is certified that error in the above-identified patent and that said Letters Patent is hereby corrected as shown below:

| | | |
|---|---|---|
| col. 07, line 20 | delete "Then" | insert --The-- |
| col. 07, line 21 | delete "simple" | insert --simply-- |
| col. 07, line 33 | after "the" | insert --system illustrated-- |
| col. 10, line 67 | after "electronic" | insert --control-- |
| [57] Abstract, line 15 | delete "mutually" | insert --manually-- |

Signed and Sealed this

Twentieth Day of October, 1992

*Attest:*

*Attesting Officer*

DOUGLAS B. COMER

*Acting Commissioner of Patents and Trademarks*